US010775054B2

(12) United States Patent
Bradford et al.

(10) Patent No.: US 10,775,054 B2
(45) Date of Patent: Sep. 15, 2020

(54) MODULAR AIR CONDITIONING SYSTEM

(75) Inventors: Kipp Bradford, Pawtucket, RI (US); Kas DeCarvalho, Providence, RI (US); Thomas Brendler, Providence, RI (US)

(73) Assignee: TREAU, INC., San Francisco, CA (US)

( * ) Notice: Subject to any disclaimer, the term of this patent is extended or adjusted under 35 U.S.C. 154(b) by 173 days.

(21) Appl. No.: 12/724,036

(22) Filed: Mar. 15, 2010

(65) Prior Publication Data

US 2010/0229585 A1 Sep. 16, 2010

Related U.S. Application Data

(60) Provisional application No. 61/159,960, filed on Mar. 13, 2009.

(51) Int. Cl.
*F24F 1/0003* (2019.01)
*F24F 1/32* (2011.01)
*F24F 1/34* (2011.01)

(52) U.S. Cl.
CPC ..... *F24F 1/0003* (2013.01); *F24F 1/32* (2013.01); *F24F 1/34* (2013.01); *F24F 2221/36* (2013.01)

(58) Field of Classification Search
CPC .... F24F 1/0003; F24F 1/32; F24F 1/34; F24F 2221/36; F25D 21/14; F25D 19/00; F25B 13/00
USPC ..... 62/259.1, 263, 285, 506, 99, 180, 186, 62/185, 238.6, 201; 251/152
See application file for complete search history.

(56) References Cited

U.S. PATENT DOCUMENTS

| | | | | |
|---|---|---|---|---|
| 4,393,662 | A | 7/1983 | Dirth | |
| 4,641,503 | A * | 2/1987 | Kobayashi | 62/259.1 |
| 4,809,516 | A | 3/1989 | Jones | |
| 5,245,835 | A | 9/1993 | Cohen et al. | |
| 5,355,688 | A | 10/1994 | Rafalovich et al. | |
| 5,445,213 | A | 8/1995 | Im | |
| 5,467,812 | A | 11/1995 | Dean et al. | |
| 5,507,337 | A | 4/1996 | Rafalovich et al. | |
| 5,682,752 | A | 11/1997 | Dean | |
| 6,138,987 | A * | 10/2000 | Lee | 251/152 |
| 6,286,316 | B1 * | 9/2001 | Waldrop et al. | 60/660 |
| 6,318,108 | B1 * | 11/2001 | Holstein et al. | 62/279 |
| 6,343,482 | B1 * | 2/2002 | Endo et al. | 62/324.6 |
| 6,389,834 | B1 | 5/2002 | LeClear et al. | |
| 6,482,332 | B1 | 11/2002 | Malach | |

(Continued)

FOREIGN PATENT DOCUMENTS

CA 2409963 A1 5/2003

*Primary Examiner* — Ana M Vazquez
(74) *Attorney, Agent, or Firm* — Davis Wright Tremaine LLP

(57) ABSTRACT

A modular air conditioner is provided that operates on the basic principal of a split system yet allows user serviceability and modular components such that the system is flexible. The system generally includes an outdoor unit, at least one indoor unit and a user serviceable hose that extends between the outdoor and indoor units. The outdoor unit contains a compressor, an air-cooled condenser, a coolant to fluid heat exchanger, a fan and various other components such as controls. While the indoor unit contains a fan, a fluid pump, a cold fluid storage tank and a fluid to air heat exchanger. Finally, the hose is a detachable hose that includes three lumens therein that act as a cold fluid supply, a fluid return and wiring for power and control signals.

20 Claims, 4 Drawing Sheets

(56) References Cited

U.S. PATENT DOCUMENTS

| | | | | |
|---|---|---|---|---|
| 6,525,505 | B2 * | 2/2003 | Bay et al. | 318/778 |
| 6,840,056 | B2 | 1/2005 | Tanaka | |
| 8,281,614 | B2 * | 10/2012 | Koo et al. | 62/506 |
| 2002/0026800 | A1 * | 3/2002 | Kasai et al. | 62/85 |
| 2003/0110789 | A1 * | 6/2003 | Cur et al. | 62/262 |
| 2006/0107683 | A1 * | 5/2006 | Song et al. | 62/324.1 |
| 2006/0157225 | A1 | 7/2006 | Martin et al. | |
| 2008/0087031 | A1 * | 4/2008 | Park et al. | 62/175 |
| 2009/0071181 | A1 | 3/2009 | Spanger | |

* cited by examiner

MODULAR AIR CONDITIONING SYSTEM

CROSS-REFERENCE TO RELATED APPLICATIONS

This application is related to and claims priority from earlier filed U.S. Provisional Patent Application No. 61/159,960, filed Mar. 13, 2009.

BACKGROUND OF THE INVENTION

The present invention relates generally to modular air conditioning systems. More specifically, the present invention relates to an air conditioning system that is formed to include an outdoor unit and at least one indoor unit, wherein the units are interconnected using a hose that is user serviceable and modular in a manner that allows reconfiguration and user serviceability as was previously unknown in the art.

In the prior art there is a wide variety of devices available for cooling desired locations such as a room in a home. In the most general terms, these cooling devices draw heat from the room into a coolant working fluid. Once the fluid has absorbed the heat, it is then routed to a location that is remote from the room so that the heat absorbed into the fluid can be discharged from the fluid into the remote location, typically outdoors. Such cooling devices, also known as room air conditioners, may be categorized as window air conditioners, where the unit resides in a window with the cooling unit on the interior and the heat discharge unit on the outside, split air conditioners, where the location of unit containing the air cooling unit and the heat discharging outdoor unit are separated from one another or unitary air conditioners, wherein the air cooling unit and the heat discharging outdoor unit are fixed relative to one another within a single housing.

One of the difficulties encountered with prior art window air conditioners and unitary air conditioners is noise. Since the entire unit is contained within a single housing the fans, pumps and fluid compressors are all positioned in a concentrated, self contained unit. As a result, such units are typically noisy to operate. Further, since the heat absorbing and heat discharging units are both positioned in the same housing, accommodations need to be made with respect to positioning of the units so that they do not operate as a closed loop within the room to be cooled. This is done in the case of a window air conditioner by placing it in a window with the cooling portion on the interior and the heat discharge portion at the exterior, creating the additional problem of blocking a window. Similarly, freestanding unitary devices must be positioned so that an air discharge duct leads to the exterior of the room and allows heat to be discharged via the duct.

In contrast to unitary air conditioners, split air conditioners provide for the interior cooling portion and the heat discharge assembly to be separated from one another in order to overcome some of the above noted issues. In split air conditioning systems, the noisiest portion of the air conditioning system is placed outdoors in a location that is remote from the room to be cooled. One type of split air conditioner is a saddle mount air conditioner. A saddle mount air conditioner typically includes a low profile service channel disposed between an indoor, air cooling unit and an outdoor, heat discharging unit to permit air, condensate water, coolant, and electricity to pass between each unit. The service channel may be placed on the sill of a window so that the indoor unit and the outdoor unit straddle the sill such that they are significantly below the horizontal level of the sill. Other larger split units require that, after installation of the interior and exterior units, connective piping be installed and charged with refrigerant. Such installations require professional technicians to complete and charge the refrigerant piping, thereby greatly increasing the cost of the installation.

Even larger air conditioning systems employ large chiller or cooling tower devices that serve to cool a working fluid at an exterior location. The working fluid is then distributed to a heat exchanger to cool a secondary cooling loop or directly through a large piping network wherein flow is controlled to multiple zones to provide selective cooling at the end location. Such systems provide multiple zone control but require the permanent installation of a large and complex arrangement of pipes and automatic control valves.

In any of the above noted installations, there is very little an end user can do to service or reconfigure the air conditioning system. While a user may install and remove a window mount or unitary air conditioner, the problem of noise within the space exists. When opting for a split or chiller based system the user must make due with the system as installed because of the large network of piping or the fact that the refrigerant lines contain high pressure refrigerant which must be handled by a licensed installer.

Still another difficulty with these prior types of installations is that they lack significant control over the directionality of the cooling. While such devices have vanes or fins to direct the cooled air to some degree, the cooling is still limited to a region that surrounds the device. Since the installation of the device is generally fixed, either because the unit sits in a window or the interior portion of a split system is permanently affixed to a wall, redirection of the cooling effect is nearly impossible. In addition, such systems are generally paired in a manner that provides a single cooling coil (evaporator) with a single heat dissipation coil (condenser) thereby eliminating the possibility of modularity or the addition of extra evaporators in connection with a single condenser and compressor.

In view of the above-described shortcomings associated with traditional style window and split system air conditioners, there is a need for a modular air conditioner that operates on the basic principal of a split system yet allows user serviceability and modular components such that the system is flexible. There is a further need for a modular air conditioning system that includes at least one indoor cooling unit that has an integrated cold store therein such that the temperature of the cold store is maintained by a circulating coolant fluid through hose connections with an outdoor heat dissipation unit.

BRIEF SUMMARY OF THE INVENTION

In this regard, the present invention provides for a modular air conditioner that operates on the basic principal of a split system yet allows user serviceability and modular components such that the system is flexible. In accordance with the present invention a modular air conditioning system is provided that is optimized for efficiently cooling the occupants of a room. The system generally includes an outdoor unit, at least one indoor unit and a user serviceable hose that extends between the outdoor and indoor units. The outdoor unit contains a compressor, an air-cooled condenser, a coolant to fluid heat exchanger, a fan and various other components such as controls. While the indoor unit contains a fan, a fluid pump, a cold fluid storage tank and a fluid to air heat exchanger. Finally, the hose is a detachable hose that includes three lumens therein that act as a cold fluid supply, a fluid return and wiring for power and control signals.

In operation, the outdoor unit operates using a traditional heat pump/air conditioning cycle to reduce the temperature of the coolant or working fluid, which in turn extracts heat from a circulating fluid via the coolant to fluid heat exchanger. The cooled circulating fluid is then circulated, via the hose, between the outdoor and indoor units wherein the cooled fluid reduces the overall temperature of the cold fluid storage tank. When cooling is needed in the indoor space, cold fluid from the cold fluid storage tank is circulated through the fluid to air heat exchanger where the fan circulates room air across the heat exchanger producing a cooling effect. This arrangement allows the room cooling function and the fluid cooling function to be decoupled from one another in a temporal sense in that the control system only operates the outdoor unit when the temperature of the circulating fluid rises above a certain set point.

To further enhance the modularity of the system, the indoor and/or outdoor units are arranged such that they include multiple hose connection points so that multiple indoor units can be connected to a single outdoor unit. Such connections may be made directly from each of the indoor units to the outdoor units or in a daisy chain arrangement. Additionally, the indoor unit may include such functionality as heat sensors and servo directed louvers to direct cooling airflow to hotspots in a room (read here room occupants). Further, the indoor unit may be configured to collect condensate and deposit it back into the cold fluid loop. The outdoor unit can then be configured to eject some fluid from the loop should the fluid capacity of the loop be exceeded by the addition of condensate.

Accordingly, it is an object of the present invention to provide a modular air conditioner that operates on the basic principal of a split system yet allows user serviceability and modular components such that the system is flexible. It is a further object of the present invention to provide a modular air conditioning system that includes at least one indoor cooling unit that has a detachable cold storage therein such that the temperature of the cold store is maintained by a circulating coolant fluid through hose connections with an outdoor heat dissipation unit. It is still a further object of the present invention to provide a modular air conditioning system that includes at least one indoor cooling unit that has a detachable cold storage unit therein such that the cooling operation conducted by the indoor and outdoor units are temporally separated thereby allowing operation of the system at its highest efficiency.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
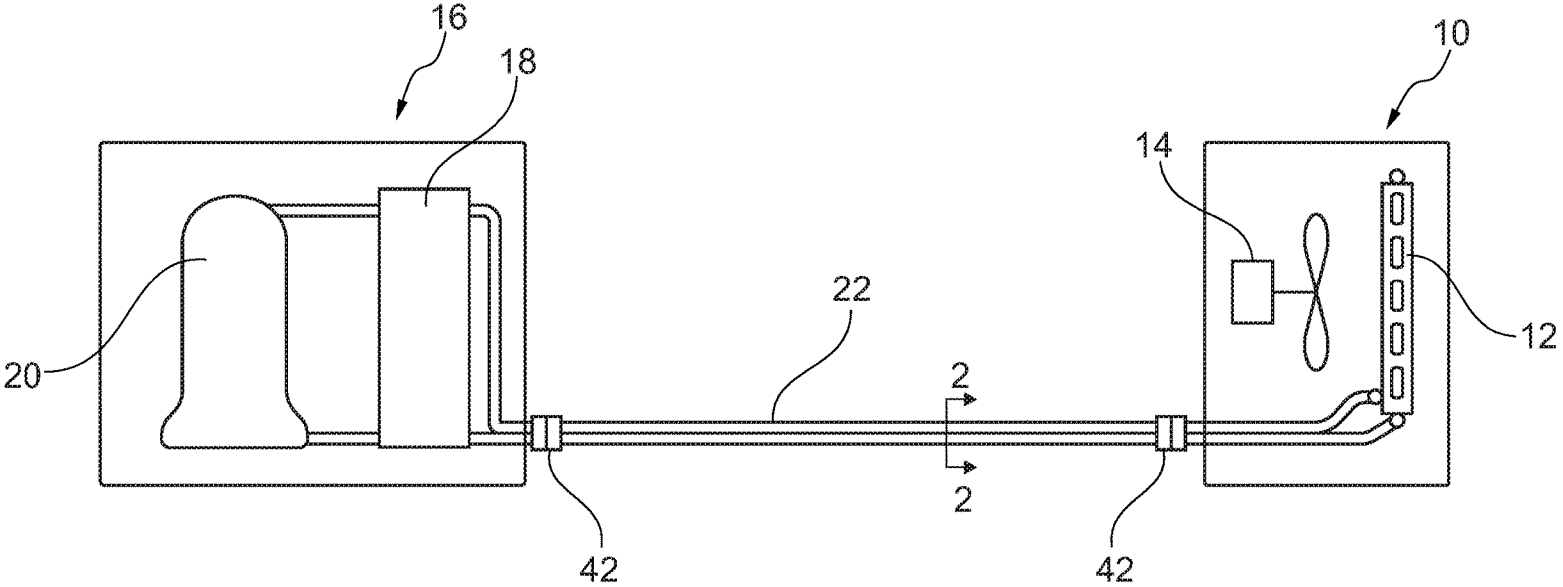
FIG. 1 is a schematic illustration of the modular climate control system of the present invention.

Now referring to the drawings, the modular climate control system is shown and generally illustrated in the figures. As can be seen at FIG. 1, the modular climate control system in its most general form includes at least one user positionable interior unit 10 wherein the interior unit 10 includes a fluid to air heat exchanger 12 and a fan 14 to circulate air across the fluid to air heat exchanger 12, an exterior unit 16 including a fluid to fluid heat exchanger 18 and a system 20 for supplying a working fluid having a controlled temperature to a first side of the fluid to fluid heat exchanger 18 and a circulation hose 22 connected between a fluid side of the fluid to air heat exchanger 12 and a second side of the fluid to fluid heat exchanger 18, wherein the circulation hose 22 allows a circulating fluid to transport heat between the at least one interior unit 10 and the exterior unit 16. As will be discussed in bore detail below, the circulating fluid is a non-toxic, user serviceable fluid and the circulation hose 22 is coupled to the at least one interior unit 10 and the exterior unit 16 in a releasable manner.

As was stated above, the present invention provides a modular air conditioning system that is optimized for efficiently cooling the occupants of a room. Turning to the exterior unit 16 in more detail, the exterior unit contains a system 20 for controlling the temperature of a working fluid. The system 20 for controlling the temperature may be a heat pump or a traditional compressor. In the case of a heat pump the system 20 can provide add or remove heat to/from the working fluid. In contrast, if only a traditional compressor is provided, the system 20 removes heat from the working fluid. Further, the exterior unit 16 includes a fluid to fluid heat exchanger 18 that allows the exchange of heat between the working fluid on one side of the heat exchanger 18 and the circulating fluid on the other side of the heat exchanger 18. A fan and various other components such as controls may also be included in the exterior unit 16.

The interior unit 10 contains at least a fan 14 and a fluid to air heat exchanger 12. More preferably, the interior unit 10 also includes a fluid pump and a circulating fluid storage tank that will operate as described below in more detail.

Figure 2:
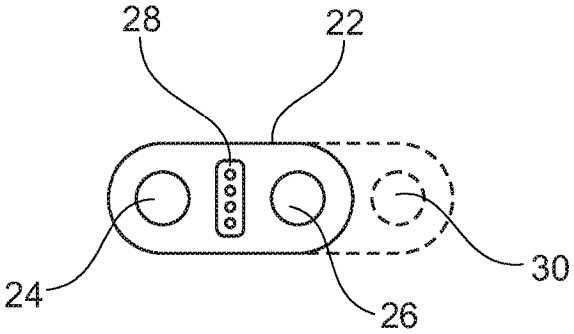
FIG. 2 is a cross section of the fluid tubing taken along line 2-2 of FIG. 1.

Finally, the circulation hose 22 is a detachable hose that extends between the interior 10 and exterior units 16. Preferably, as can be seen at FIG. 2, the circulation hose 22 includes three lumens therein that act as a fluid supply 24, a fluid return 26 and wiring 28 for power and control signals between the interior 10 and exterior units 16. The circulation hose 22 may further optionally include a fourth lumen 30 to serve as a conduit to convey condensate back to the exterior unit 16 from the interior unit 10 preventing the need for a condensate drain therein.

It can be appreciated by one skilled in the art that within the scope of the present invention we have described an outdoor unit, however, it should be appreciated that the outdoor unit may be positioned indoors as well at a location wherein the user is not concerned about the potential for heat gain. Further, it is anticipated within the scope of the present invention that the air-cooled condenser may be a fluid cooled condenser and more particularly a condenser that is cooled using ground source water.

Figure 3:
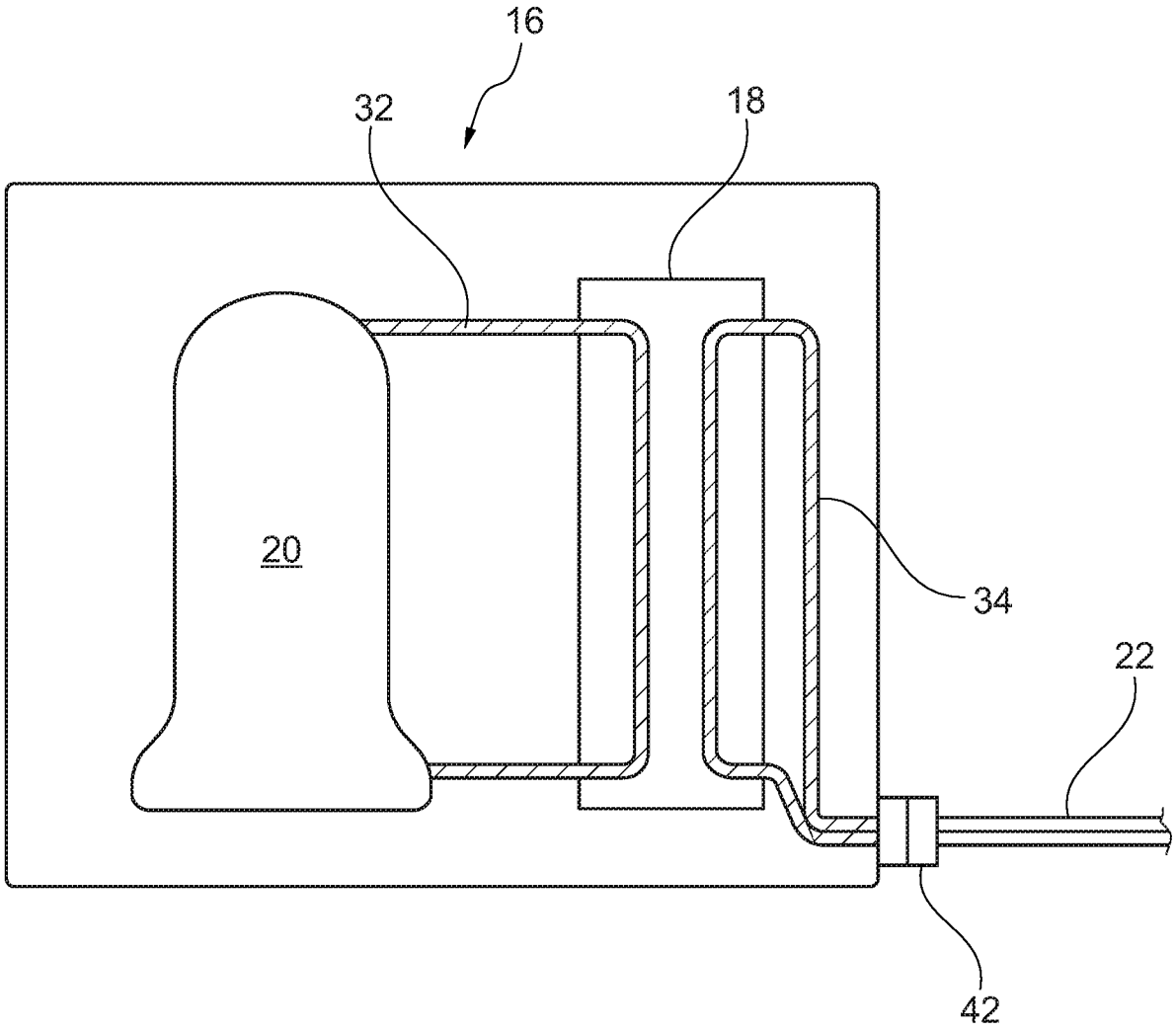
FIG. 3 is a schematic view of an exterior unit.

As illustrated at FIG. 3, in operation the outdoor unit 16 operates using a traditional heat pump/air conditioning cycle to reduce the temperature of the working fluid 32 or coolant, which in turn extracts heat from a circulating fluid 34 via the fluid to fluid heat exchanger 18. As the details of the remainder of this process are known in the art they will not be further discussed herein.

Figure 4:
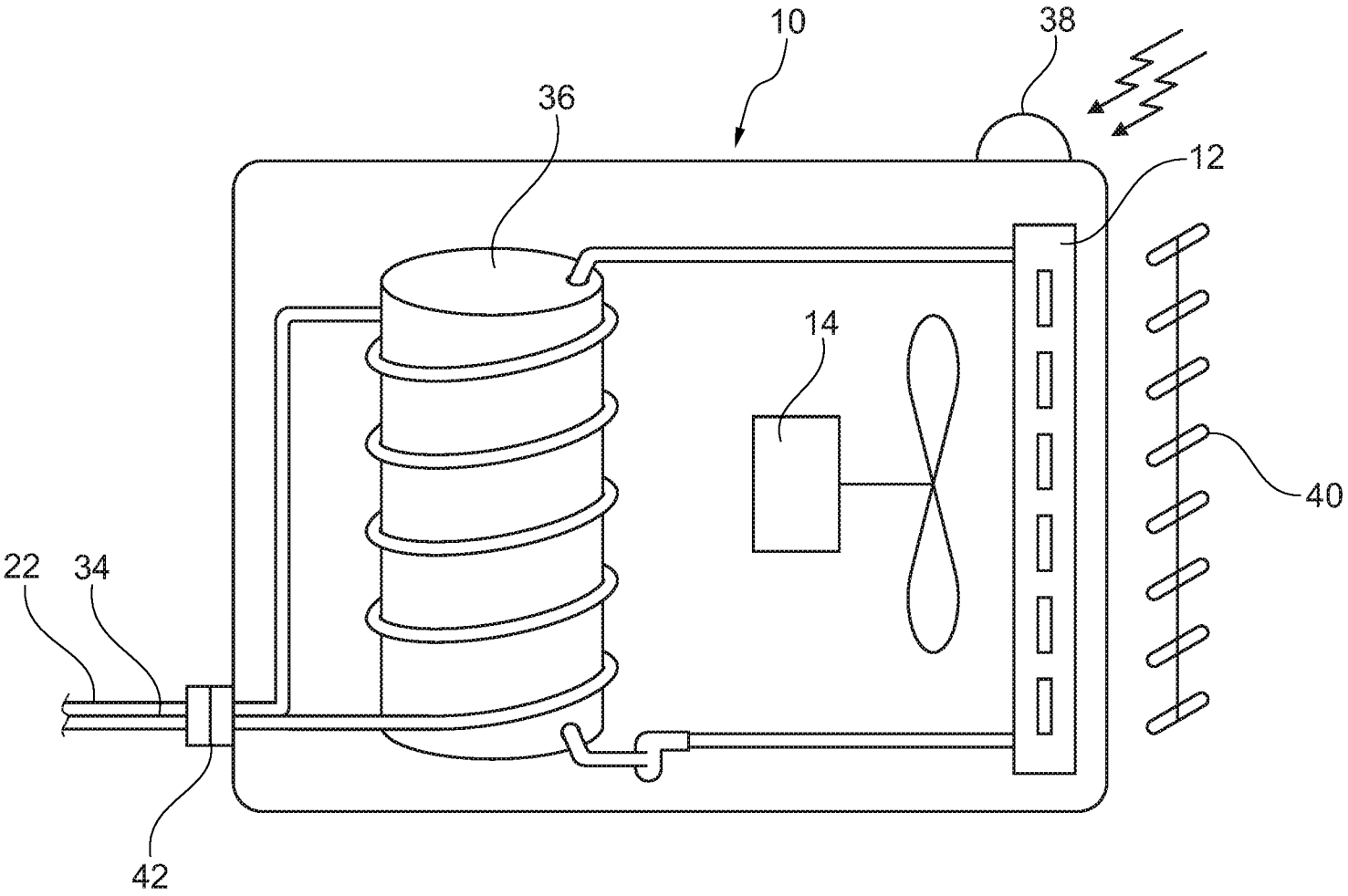
FIG. 4 is a schematic view of an interior unit.
Figure 6:
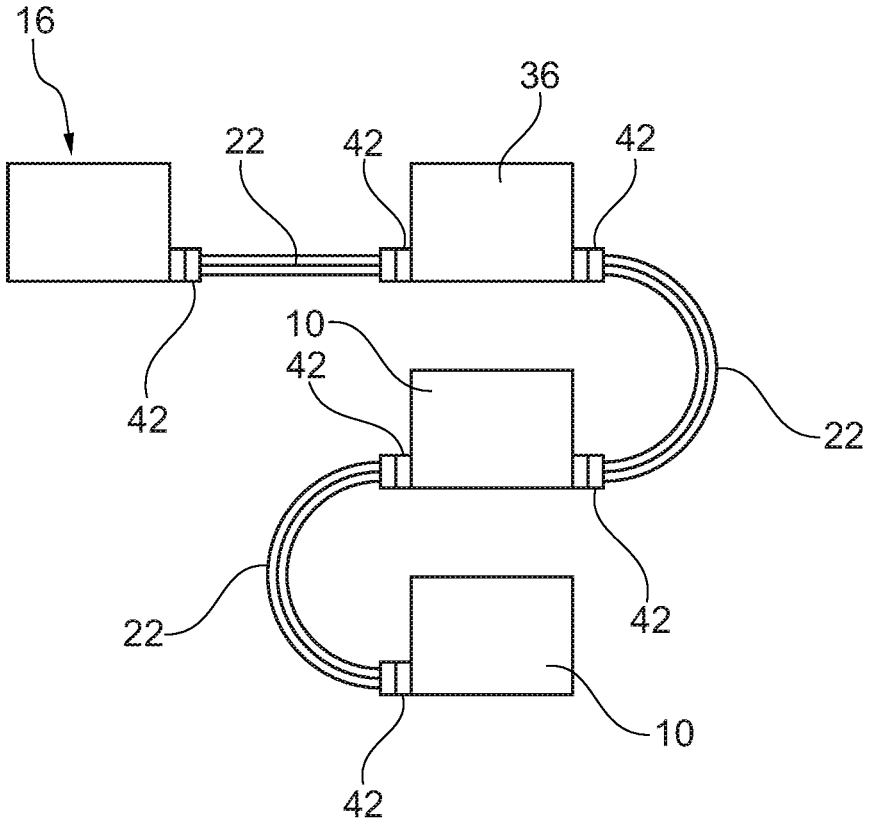

The cooled circulating fluid 34 is then circulated, via the circulation hose 22, between the exterior 16 and interior 10 units. As was illustrated at FIG. 1, the circulating fluid 34 may be directed through the fluid to air heat exchanger 12 in the interior unit 18 to cool the air directly. Further, as can be seen at FIG. 4, the circulating fluid 34 may be directed to reduce the overall temperature of a fluid storage tank 36 within the interior unit 10. In this embodiment, when cooling is needed in the indoor space, cold fluid from the cold fluid storage tank 36 is circulated through the fluid to air heat exchanger 12 where the fan 14 circulates room air across the heat exchanger 12 producing a cooling effect. One skilled in the art should appreciate that while the fluid storage tank 36 is shown in the interior unit 10 it could also be positioned within the exterior unit 16 or independently at an intermediate position along the circulation hose 22 as depicted in FIG. 6. This arrangement allows the room cooling function and the fluid cooling function to be decoupled from one another in a temporal sense in that the control system only operates the outdoor unit when the temperature of the circulating fluid rises above a certain set point. Similarly, the indoor unit can independently increase or decrease fan speed and fluid circulation rate in order to provide a great deal of control over the cooling effect as compared to the prior art on or off cooling systems. This decoupling of the indoor cooling loop and the outdoor cooling loop further allows the outdoor unit to cool the fluid when it is most efficient to do so. For example, the outdoor unit may cool the fluid stored in the interior insulated cold fluid storage tank at night for cooling use during the day when the outdoor ambient temperatures increase.

It is of further note that the circulating fluid is a non-toxic, low freezing point coolant such as salt brine of water mixed with polyethylene glycol. This can be contrasted with the prior art systems that circulated a refrigerant such as Freon or R-10 between the indoor and outdoor units. The arrangement of the present invention allows a user to selectively connect an indoor unit with an outdoor unit using a modular hose arrangement thereby eliminating a great deal of complexity and cost. Further, this arrangement allows for freedom in placing the indoor unit as need for maximum cooling effect and occupant comfort. More preferably, the circulation hoses 22 are attached to the indoor 10 and outdoor 16 units using a quick release style coupler 42. Still more preferably the quick release couplers 42 include a valving therein that prevents leakage of circulating fluid 34 when the circulation hoses 22 are disconnected.

Figure 5:
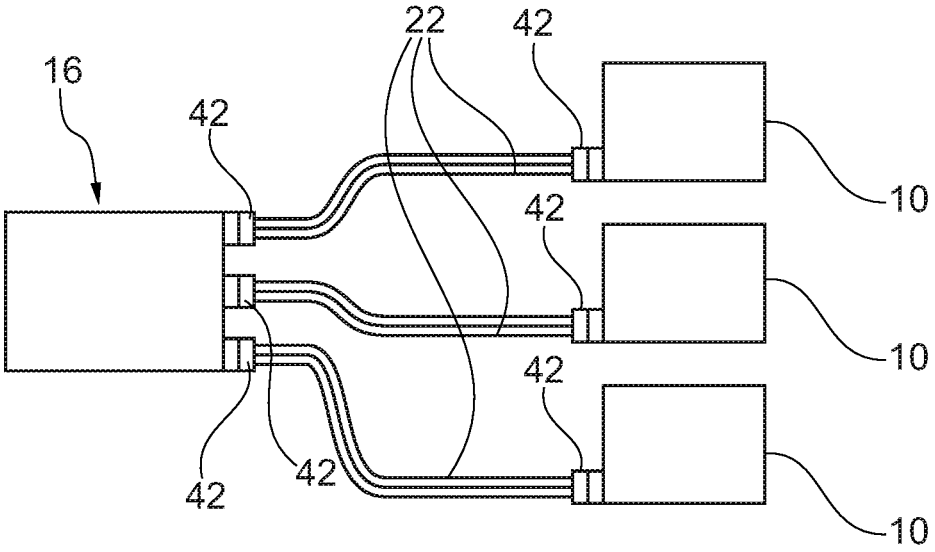
FIGS. 5-6 are illustrations showing various configurations of interior and exterior units.

To further enhance the modularity of the system, the indoor and/or outdoor units are arranged such that they include multiple hose connection points so that multiple indoor units can be connected to a single outdoor unit. Such connections may be parallel or made directly from each of the indoor units 10 to the outdoor unit 16 as shown in FIG. 5. Alternately the indoor units 10 may be connected in series or in a daisy chain arrangement with the outdoor unit 16 as shown at FIG. 6. Turning back to FIG. 4, the indoor unit 10 may include such functionality as heat sensors 38 and servo directed louvers 40 to direct cooling airflow to hotspots in a room (read here room occupants). Further, the indoor unit 10 may be configured to collect condensate and deposit it back into the circulating fluid 34 loop. The outdoor unit 16 can then be configured to eject some fluid from the loop should the fluid capacity of the loop be exceeded by the addition of condensate.

It should be further appreciated by one skilled in the art that the arrangement of the present invention could operate equally well as a heating system. In operation the only change that would need to be made is that the outdoor unit would be run as a heat pump rather than as an air conditioner. In this manner rather than cooling the circulating fluid, the outdoor would heat the circulating fluid. Optionally, the indoor units may instead include a supplemental heating arrangement such as an electrical heating coil.

It can therefore be seen that the present invention provides a modular air conditioner that operates on the basic principal of a split system yet allows user serviceability and modular components such that the system is flexible. Further the present invention provides a modular air conditioning system that includes at least one indoor cooling unit that has an integrated cold storage therein such that the temperature of the cold store is maintained by a circulating coolant fluid through user serviceable hose connections with an outdoor heat dissipation unit. For these reasons, the present invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A modular climate control system coupled within an open window of a building, with the window separating an indoor area within the building and an outdoor area external to the building, the modular climate control system straddling a sill of the window and consisting essentially of:

an interior unit disposed at the window within the indoor area below a horizontal level of the sill, said interior unit including:

a fluid to air heat exchanger and a fan to circulate air across said fluid to air heat exchanger;

an exterior unit disposed at the window in the exterior area below the horizontal level of the sill, the exterior unit including:

a fluid to fluid heat exchanger and a system for supplying a working fluid that undergoes a pressure drop to cool said working fluid, said working fluid within a first circulation loop, said cooled working fluid being directed to a first side of said fluid to fluid heat exchanger; and a circulation hose that extends through the window and over the sill to connect the exterior unit and the interior unit, the circulation hose connected between a fluid side of said fluid to air heat exchanger and a second side of said fluid to fluid heat exchanger, said circulation hose allowing a circulating fluid, that is maintained separate and apart from said working fluid, within a second circulation loop, to transport heat between said interior unit and said exterior unit such that the cooling of said working fluid and the cooling of said circulating fluid are temporally decoupled from one another, wherein said circulating fluid is a non-toxic, user serviceable fluid and wherein said circulation hose is coupled to said interior unit and said exterior unit in a releasable manner, wherein a user can uncouple and recouple any number of modular interior units with said exterior unit without disrupting said first circulation loop containing said working fluid.

2. The modular climate control system of claim 1, wherein said system for supplying the working fluid is a heat pump and said working fluid is a refrigerant.

3. The modular climate control system of claim 2, wherein said heat pump can heat or cool said working fluid which in turn heats or cools said circulating fluid.

4. The modular climate control system of claim 3, said interior unit further comprising:

a fluid storage reservoir in communication with said second circulation loop therein to store heated or cooled circulating fluid until required.

5. The modular climate control system of claim 4, wherein said interior unit includes a condensate pump that deposits condensate into said fluid storage reservoir.

6. The modular climate control system of claim 1, wherein said system for supplying the working fluid is an air conditioning system and said working fluid is a refrigerant.

7. The modular climate control system of claim 6, wherein said air conditioning system cools said working fluid which in turn cools said circulating fluid.

8. The modular climate control system of claim 7, said interior unit further comprising:

a fluid storage reservoir therein to store cooled circulating fluid until required.

9. The modular climate control system of claim 8, wherein said interior unit includes a condensate pump that deposits condensate into said fluid storage reservoir.

10. The modular climate control system of claim 1, wherein said circulating fluid is selected from the group consisting of: brine, water and glycol.

11. The modular climate control system of claim 10, wherein said circulation hose includes a first lumen to supply circulating fluid to said interior unit a second lumen to return circulating fluid to said exterior unit and a third lumen to provide power to said interior unit.

12. The modular climate control system of claim 11, wherein said interior unit includes a condensate pump and said circulation hose includes a fourth lumen to transport condensate to said exterior unit.

13. The modular climate control system of claim 11, wherein said circulation hose is affixed to said interior and exterior units using modular quick release connectors.

14. The modular climate control system of claim 13, wherein said quick release connectors include valves therein to contain said circulating fluid when said circulation hose is disconnected.

15. The modular climate control system of claim 1, wherein a plurality of modular interior units are configured to be interconnected to said exterior unit by a plurality of connection hoses.

16. The modular climate control system of claim 15, wherein said plurality of modular interior units are connected in series.

17. The modular climate control system of claim 15, wherein said plurality of modular interior units are connected in parallel.

18. The modular climate control system of claim 15, wherein said circulation hoses are affixed to said interior and exterior units using modular quick release connectors.

19. The modular climate control system of claim 18, wherein said quick release connectors include valves therein to contain said circulating fluid when said circulation hose is disconnected.

20. The modular climate control system of claim 1, wherein said interior unit includes a fluid storage reservoir.

* * * * *